US005449797A

United States Patent [19]

Estes et al.

[11] Patent Number: 5,449,797

[45] Date of Patent: Sep. 12, 1995

[54] PROCESS FOR THE REMOVAL OF SOAP FROM GLYCERIDE OILS AND/OR WAX ESTERS USING AN AMORPHOUS ADSORBENT

[75] Inventors: Jennifer A. Estes, Columbia; Cathy L. Harville, Gambrills, both of Md.; Felix A. Guerrero, Bogotá, Colombia

[73] Assignee: W. R. Grace & Co.-Conn., New York, N.Y.

[21] Appl. No.: 868,064

[22] Filed: Apr. 13, 1992

[51] Int. Cl.[6] ..... C11B 3/10

[52] U.S. Cl. ..... 554/191; 554/190

[58] Field of Search ..... 554/190, 191

[56] References Cited

U.S. PATENT DOCUMENTS

| | | | |
|---|---|---|---|
| 4,629,588 | 12/1986 | Welsh et al. | 554/191 |
| 4,698,185 | 10/1987 | Dijkstra et al. | 554/191 |
| 4,877,765 | 10/1989 | Pryor et al. | 554/191 |
| 4,939,115 | 7/1990 | Parker et al. | 554/191 |
| 5,239,097 | 8/1993 | Wolf et al. | 554/190 |
| 5,248,799 | 9/1993 | Schmulyter | 554/192 |
| 5,298,639 | 3/1994 | Toeneboehn | 554/192 |

*Primary Examiner*—José G. Dees
*Assistant Examiner*—Deborah D. Carr
*Attorney, Agent, or Firm*—Steven Capella

[57] ABSTRACT

The invention improves on the amorphous adsorbent-based processes by overcoming the soap leaching problem without using filtration before vacuum bleaching. For fatty materials containing only minor amounts of phospholipid and trace metal impurities, simply vacuum drying at least a portion of the soap-containing fatty material prior to contacting with the amorphous adsorbent eliminates the soap leaching problem. For fatty materials containing higher amounts of phospholipid and trace metals, simply using an acid pretreatment and the vacuum drying step eliminate the soap leaching problem.

31 Claims, 4 Drawing Sheets

PROCESS FOR THE REMOVAL OF SOAP FROM GLYCERIDE OILS AND/OR WAX ESTERS USING AN AMORPHOUS ADSORBENT

BACKGROUND OF THE INVENTION

Fatty acid-based materials (fatty materials) such as glyceride oils, wax esters, milk fat, and other fatty acid compounds have a long history of use since many of these materials are naturally derived from plants (e.g. vegetable oils) or animals (e.g. tallow, milk fat, etc.).

While these fatty materials often have been directly used in their crude state, modern commercial products based on these materials are typically subjected to a refining process. Refining processes may be used to remove various impurities which are undesirable for reasons of health, performance, aesthetics, etc.

The fatty material may contain impurities such as color bodies, chlorophyll, phospholipids (phosphatides), trace metals (e.g. Ca, Mg, Fe), free fatty acids (FFA), gums, soaps and/or other impurities. This variety of diverse impurities has led to the development of numerous refining processes involving particular combinations of chemical and/or physical treatment steps. A detailed review of refining processes may be found in the "Handbook for Soy Oil Processing and Utilization," ed. by David R. Erikson et al., ASA/AOCS Monograph, 1980.

Recently, new refining processes have been developed which share the common feature that an amorphous adsorbent is contacted with a soap-containing fatty material whereby soap and possibly other impurities in the fatty material are adsorbed by the amorphous adsorbent. Such refining processes are disclosed in European Patent Application 0247411 (EP '411—"MCR") and U.S. patent application Ser. No. 07/677455 (Ser. No. '455—"MPR"), filed Apr. 3, 1991. The disclosures of these applications are incorporated herein by reference.

In the EP '411 process, large amounts of soap are intentionally created in the fatty material by the addition of a chemical base (e.g. NaOH) to the fatty material at a point in the '411 process to eliminate free fatty acid and to facilitate removal of other impurities. The bulk of the soap is then separated from the fatty material by a primary centrifuge. The fatty material output from the primary centrifuge is then contacted with an amorphous adsorbent (e.g. a silica gel) to remove residual soaps and impurities from the fatty material. Immediately after the adsorption or at some point downstream in the process, the soap-containing adsorbent is separated from the fatty material. The fatty material may be subjected to additional refining steps (e.g. bleaching, deodorizing, etc.) before and/or after the separation of the amorphous adsorbent.

The Ser. No. '455 process differs from the EP '411 process by creating only a small amount of soap by addition of chemical base. The smaller amount of soap can be removed from the fatty material by simply contacting with amorphous adsorbent, i.e. without need for the primary centrifuge step. As with the EP '411 process, the fatty material may be subjected to additional refining steps before and/or after separation of the amorphous adsorbent.

A problem exists with these amorphous adsorbent-based processes if one tries to subject the fatty material to vacuum bleaching before removal of the soap-containing adsorbent. Namely, adsorbed soap appears to leach out of the amorphous adsorbent in the vacuum bleacher. This problem occurs even if the amount of soap initially created is decreased relative to the amount of amorphous adsorbent used. Soap leaching is undesirable since it causes sliming of packed beds and filters used in the refining process. Since commercial refining processes are typically continuous processes with large throughput, even concentrations of a few ppm of soap are generally unacceptable since the effect of the soap is magnified by the large throughput. Also, the presence of soap in the fatty material after vacuum bleaching can have adverse effects in subsequent processing steps.

To date, the only solution to this problem has been to separate out the soap-containing adsorbent prior to vacuum bleaching. However, the insertion of a filtration step before the vacuum bleacher may be commercially undesirable or difficult to install in an existing refining set up. Thus, there is a need for a way to overcome the soap leaching problem without resorting to filtration before vacuum bleaching.

SUMMARY OF THE INVENTION

The invention improves on the amorphous adsorbent-based processes by overcoming the soap leaching problem without using filtration before vacuum bleaching. For fatty materials containing only minor amounts of phospholipid and trace metal impurities, simply vacuum drying at least a portion of the soap-containing fatty material prior to contacting with the amorphous adsorbent eliminates the soap leaching problem. For fatty materials containing higher amounts of phospholipid and trace metals, simply using an acid pretreatment and the vacuum drying step eliminates the soap leaching problem.

In a process for treating a fatty material containing water and soap, the process comprising:

a) contacting the material with a silica-based amorphous adsorbent whereby soap is adsorbed by the adsorbent, and b) subsequently removing the soap-containing adsorbent from the material, the invention comprises the improvement of drying at least a portion of the fatty material prior to the contacting with adsorbent.

In a more specific process for treating a fatty material, the process comprising a) combining the material with a base to form soap, b) contacting the soap-containing material with a silica-based amorphous adsorbent whereby soap is adsorbed by the adsorbent, and c) removing the soap-containing adsorbent from the material, the invention comprises the improvement of:

i) acid pretreating the fatty material prior to or during step a), and ii) drying at least a portion of the material between steps a) and b).

In another preferred embodiment, the improvement may also comprise:

iii) bleaching the material between steps b) and c).

Preferably, the drying step of the invention comprises vacuum drying at least a portion of the fatty material. More preferably, all of the fatty material is dried in the drying step. Preferably, the drying is carried out so the fatty material to be contacted with the amorphous adsorbent has a water content of less than about 0.6 wt. %, more preferably about 0.1–0.2 wt. %.

The acid pretreatment step preferably comprises mixing into the fatty material, a minor amount of an acid. Phosphoric acid is preferred. The bleaching step preferably is a vacuum bleaching.

These and other aspects of the invention will be discussed in more detail below.

DETAILED DESCRIPTION OF THE INVENTION

Broadly, the invention relates to the treatment of any fatty material containing soap and water where the material is to be contacted with an amorphous adsorbent for purposes of removing soap and possibly other contaminants from the fatty material. The improvement of the invention encompasses drying the fatty material prior to the contacting step.

This drying step results in improved adsorption efficiency and/or reduction in the required amount of adsorbent. Additionally, for fatty materials containing only minor amounts of phospholipid and trace metal (e.g. corn oil) the drying step results in improved retention of the adsorbed soap in the adsorbent whereby the fatty material containing the adsorbent can be sent to a downstream vacuum bleacher without prior removal of the adsorbent and without leaching of the soap.

The initial fatty material containing soap and water may be generated by any desired series of process steps, even crude fatty materials or used fatty materials may be used, assuming they contain soap and water. Preferably, the initial fatty material to be treated by the process of the invention is prepared by the steps of a caustic refining process Up through the primary centrifuge or by the caustic addition step of the MPR process described in Ser. No. '455.

For purposes of illustration only, the invention will be described with respect to the process flow diagrams shown in FIGS. 1–4. The invention is not limited to the particular embodiments shown in the figures.

Figure 1:
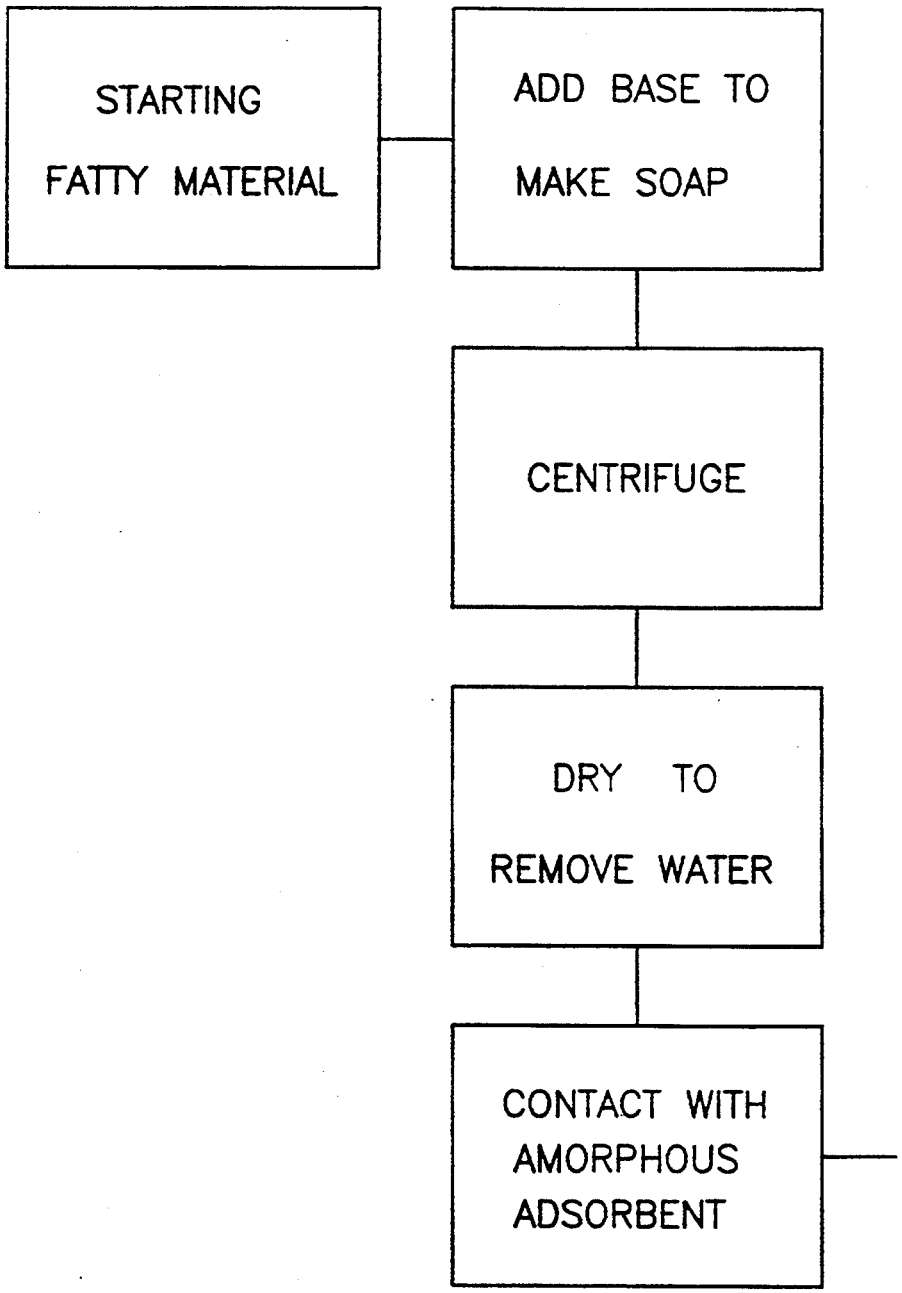
FIG. 1 is a flow diagram for the improvement of the invention as applied to a modified caustic refining process.

FIG. 1 shows an example of the improvement of the invention in the general context of a modified caustic refining process. In FIG. 1, a fatty material is treated with a chemical base to form soap (typically about 7000–10000 ppm). The resulting mixture is fed to a primary centrifuge where the bulk of the soap and water is removed. The centrifuged fatty material still contains a significant amount of soap and water due to the limitations of centrifuge separation. According to the improvement of the invention, the centrifuged material is then dried prior to contact with the amorphous adsorbent.

Figure 3:
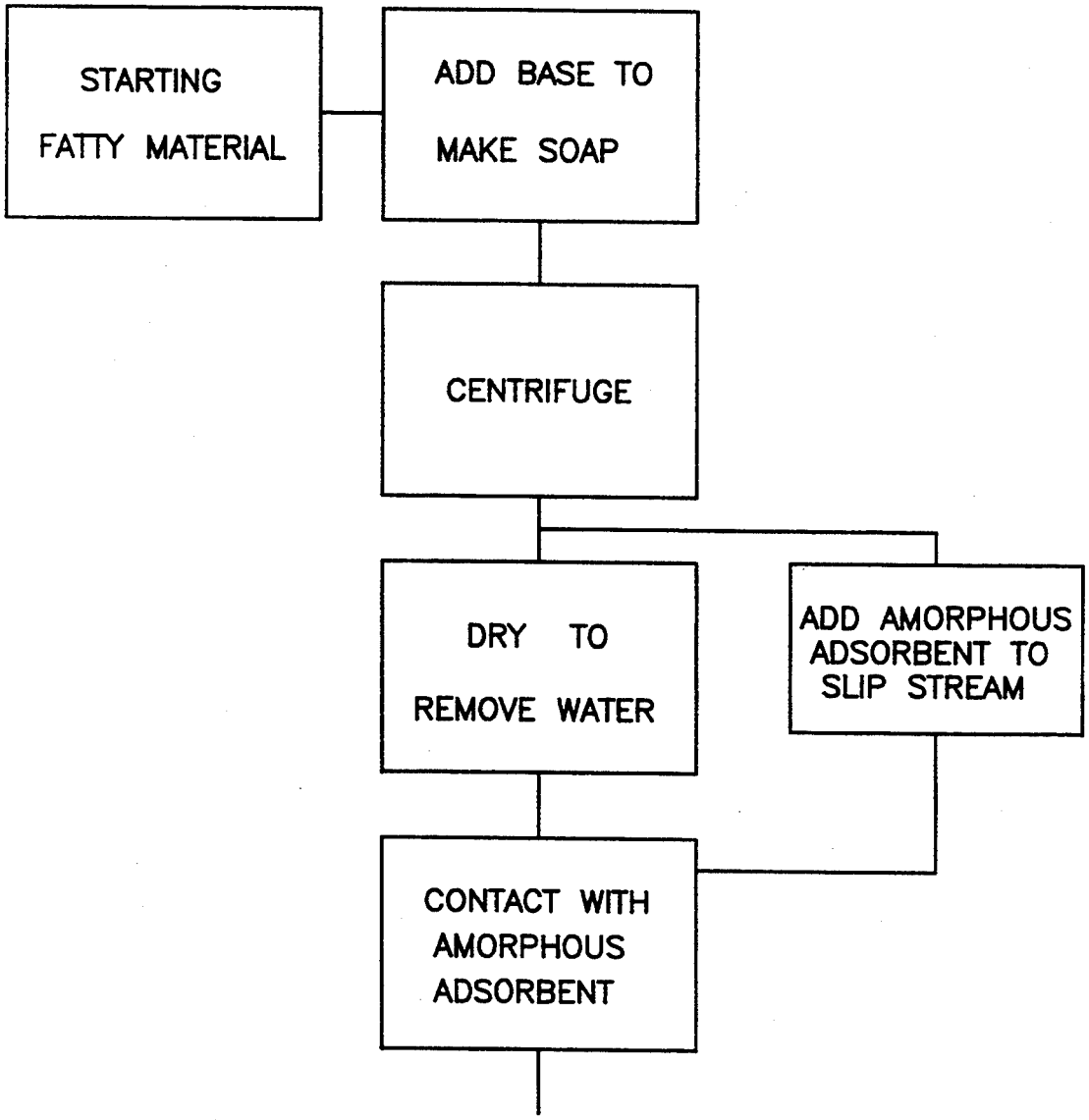
FIG. 3 is a flow diagram for the improvement of the invention as applied to a slip stream configuration of the process shown in FIG. 1.

While FIG. 1 shows the entire flow of fatty material going to the dryer, another option is shown in FIG. 3 where a slip stream of the centrifuge output is combined with the amorphous adsorbent while the major portion of the centrifuge output is dried before contact with the amorphous adsorbent.

Once the fatty material has been contacted with the amorphous adsorbent, the fatty material may be subjected to any desired processing steps known in the art. Typically, it is often desired to feed the fatty material to a vacuum bleacher followed by filtration. This can easily be done with the amorphous adsorbent-contacted material of the invention without leaching of the soap from the adsorbent. If desired, the amorphous adsorbent contacting step and the bleaching step may be combined by use of sequential packed beds or other expedients known in the art.

Figure 2:
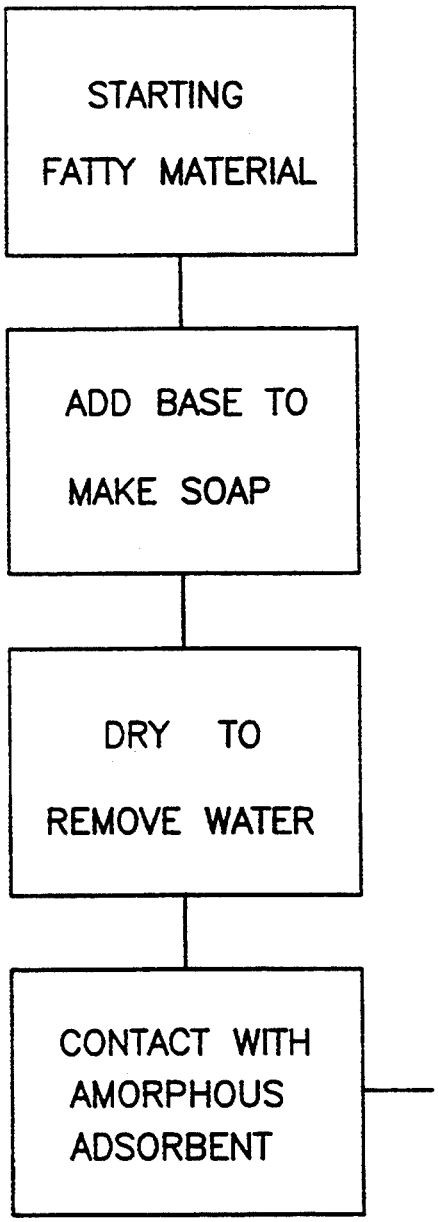
FIG. 2 is a flow diagram for the improvement of the invention as applied to an MPR type process.
Figure 4:
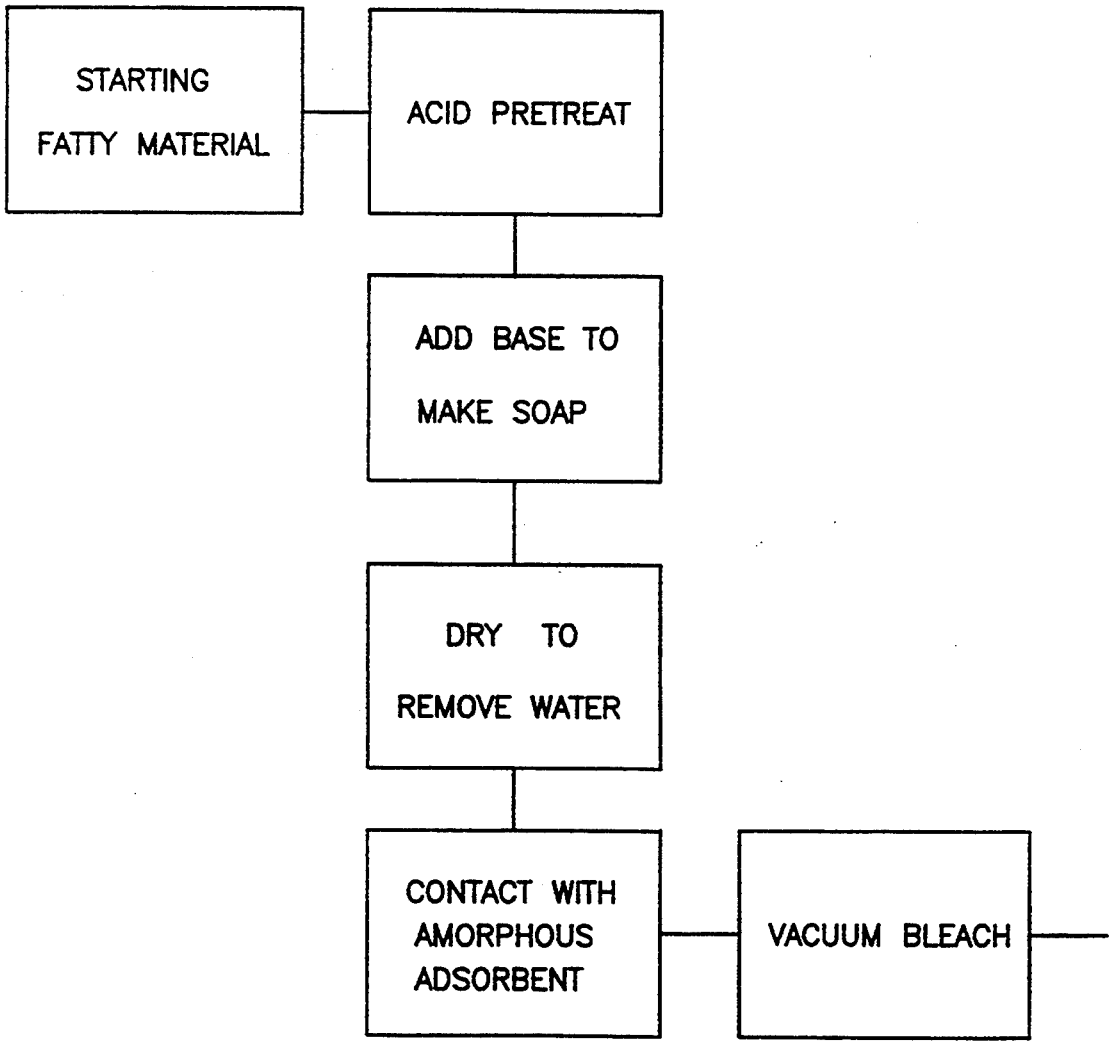
FIG. 4 is a flow diagram of the process illustrated in FIG. 3 with the addition of acid pretreatment and vacuum bleaching steps.

FIGS. 2 and 4 show examples of the invention as applied to an MPR-type process as described in Ser. No. '455. FIG. 2 shows the first required step of which is the creation of soap (typically about 20–3000 ppm) by treating the fatty material with a chemical base. The soap-containing material is then dried prior to contact with the amorphous adsorbent. As with the process shown in FIG. 3, a slip stream could be used for addition of the amorphous adsorbent while the majority of the soap-containing fatty material is dried prior to contact with the amorphous adsorbent.

As with the modified caustic refining process of FIG. 1, once the fatty material has been contacted with the amorphous adsorbent, the fatty material may be subjected to any desired processing steps known in the art. Advantageously, the fatty material can be fed to a vacuum bleacher prior to removal of the amorphous adsorbent without leaching of the soap from the adsorbent. If desired, the amorphous adsorbent contacting step and the bleaching step may be combined by use of sequential packed beds or other expedients known in the art.

For fatty materials containing substantial amounts of phospholipids and trace metals, vacuum drying alone may not result in complete prevention of soap leaching in the vacuum bleacher. With such fatty materials, the use of an acid pretreatment, prior to or in conjunction with the soap forming step, in addition to drying after soap formation surprisingly solves the soap leaching problem. It should be understood that this embodiment would also work for low phospholipid starting materials such as corn oil.

FIG. 4 shows another MPR process variation where the fatty material is specifically subjected to an acid pretreatment prior to or in conjunction with the soap formation step. This embodiment which uses both acid pretreatment and the drying step of the invention is especially preferred as providing the best performance in terms of removal of soap and phospholipids and resistance to soap leaching in the vacuum bleacher.

The drying step of the invention is preferably performed to achieve a water content in the fatty material of about 0.6 wt. % or less, more preferably about 0.1–0.2 wt. %. While drying to less than 0.1 wt. % moisture can be used under the invention, excess drying is preferably avoided otherwise inversion of the soap may occur making removal of the soap extremely difficult.

The drying may be performed using any known technique, however vacuum drying is generally preferred. Preferably, the drying is performed at about 70°–110° C. The temperature, degree of vacuum, and retention time in the dryer may be adjusted easily to achieve the desired amount of drying (i.e. the desired water content).

The amorphous adsorbent may be any known silica-based amorphous adsorbent. Preferably, the amorphous adsorbent is a silica-based amorphous adsorbent containing up to 10 wt. % of other oxides. The silica-based amorphous adsorbent is preferably selected from the group consisting of silica gel, precipitated silica, dialytic silica, fumed silica, silica-alumina and mixtures thereof. The silica-based adsorbent may contain water (e.g. a hydrogel) or may be completely dried (e.g. a xerogel). The silica-based adsorbent may also optionally be pretreated with an acid or base. The most preferred amorphous adsorbents are acid-treated silica gels. The amorphous adsorbent may be used in admixture with other materials, such as clays, earths, etc., as long as those other materials do not substantially prevent the amorphous adsorbent from performing its adsorbing function in the contacting step.

While amorphous adsorbent can be added to the fatty material of the invention before the drying step (e.g. with the addition of chemical base), the invention would require a separate amorphous adsorbent contacting step (i.e. with additional amorphous adsorbent) which is preceded by a fatty material drying step.

The acid pretreatment step described above may be conducted in any known manner with any suitable acid. In general, the amount of acid needed may depend on the amount of phospholipid present in the oil initially; preferably, about 50–1000 ppm acid is used based on the fatty material. Examples of suitable acids are phosphoric acid and citric acid. Phosphoric acid or other strong acids are most preferred.

The soap creation step of the MPR process may be carried out by any of the methods described in Ser. No. '455. Surprisingly, it has been found that the amount of soap created needed is only about 20–300 ppm, more preferably about 100 ppm. Also, the use of acid pretreatment does not necessarily require the addition of a higher amount of base in the soap creation step as long as the soap level generated is in the preferred range.

The bleaching step referred to above may be any conventional bleaching step, however vacuum bleaching is generally preferred as having the least adverse effect on the fatty material. In the vacuum bleaching, any conventional bleaching earth or clay may be used. Preferably, the amorphous adsorbent-containing fatty material is fed to the vacuum bleacher without any intermediate filtration steps.

If bleaching is unnecessary for a particular situation, the amorphous adsorbent may be separated from the fatty material after the contacting step by any conventional means. The fatty material may then be further treated by any desired processing steps such as deodorizing, hydrogenation, etc.

The fatty material treated according to the invention may be any fatty acid-based material such as glyceride oils (e.g. corn oil, soybean oil, etc.), wax esters, milk fat, other fatty acid compounds and mixtures thereof.

The invention is further illustrated by the following examples. The soap levels were determined by AOCS Recommended Practice Cc 17–79. The invention is not limited to the details recited in the examples.

EXAMPLES

Example 1

1000 g water-degummed soybean oil (SBO) (analysis given table I below) was heated to 50° C. in a water bath. 5.0 g 18 °Be (13 wt. %) NaOH solution was added to the oil and mixed with constant agitation for 30 min. at 50° C. and atmospheric pressure. This resulted in an oil having a soap content of 445 ppm and a moisture content of 0.567 wt. %.

The soap-containing oil was then heated to 70° C. in a water bath and a vacuum (30 inches—water) was applied for 10 minutes with constant agitation to dry the oil. The dried oil had a moisture content of 0.169 wt. %.

The 300 g of the dried oil was then combined with 1.8 g (0.6 wt. % ) TriSyl ®600 amorphous silica hydrogel (64.44 wt. % total volatiles), sold by W. R. Grace & Co. Conn., Davison Chemical Division, under agitation for 30 minutes at 70° C. and atmospheric pressure. The mixture was then heated in a 100° C. water bath and vacuum (30 in. water) was applied with constant agitation for 20 minutes to vacuum bleach the oil. The bleached oil was cooled to 70° C. and filtered to remove the amorphous silica. The impurities content of the resulting oil was measured and is shown in Table 1 below.

Comparison Example

As a control example for comparison, an identical water-degummed soybean oil was treated in the same manner as above except that the vacuum drying step before contact with the amorphous adsorbent was omitted. The values for the control example are also reported in Table 1.

The treated oil of Example 1 shows decreased soap content as well as substantially decreased P, Ca, and Mg content compared to the control.

Example 2

1000 g water degummed SBO of Example 1 was heated to 50° C. in a water bath. 0.144 g 85% $H_3PO_4$ was added to the oil at atmospheric pressure with constant agitation and mixed for 10 min at 50° C. Next, 5.0 g 18 °Be (13 wt. %) NaOH solution was added to the acid-treated oil and mixed with constant agitation for 30 min at 50° C. at atmospheric pressure. The soap content of the oil was 107 ppm. The moisture content of the oil was 0.534 wt. %.

In the adsorption step, 300 g soapy oil was treated with 1.8 g (0.6 wt. %) TriSyl ® 600 silica under agitation for 30 min at atmospheric pressure and 70° C. The mixture was then transferred to a 100° C. water bath where vacuum (30 in. water) was applied with constant agitation for 20 min at 100° C. to bleach the oil. The mixture cooled to 70° C. and filtered.

The results in Table 1 show decreased levels of all impurities yet a residual amount of soap remains.

Example 3

1000 g water degummed SBO of Example 1 was heated to 50° C. in a water bath. 0.144 g 85% $H_3PO_4$ was added to the oil at atmospheric pressure with constant agitation for 10 min at 50° C. 5.0 g 18 °Be (13 wt. %) NaOH solution was added to the acid-treated oil at atmospheric pressure with constant agitation for 30 min at 50° C. The soap content of the oil was 125 ppm. The moisture content of the oil was 0.537 wt. %.

700 g soapy oil was heated to 70° C. in a water bath. Vacuum (30 in. water) was applied and with constant agitation mixed for 10 min at 70° C. to remove the moisture. The moisture content of the dried oil was 0.189 wt. %.

In the adsorption step, 300 g dried soapy oil was treated with 1.8 g (0.6 wt. %) TriSyl ® 600 silica under agitation for 30 min at atmospheric pressure and 70° C. The mixture was then transferred to a 100° C. water bath where vacuum (30 in. water) was applied with constant agitation for 20 min at 100° C. to bleach the oil. The mixture cooled to 70° C. and filtered.

The results of this example in Table 1 show a substantial reduction in all impurities. No residual soap remains.

Example 4

1000 g water degummed SBO of Example 1 was heated to 50° C. in a water bath. 0.187 g 85% $H_3PO_4$ was added to the oil at atmospheric pressure with constant agitation for 10 min at 50° C. 5.0 g 18 °Be (13 wt. %) NaOH solution was added to the acid-treated oil at atmospheric pressure with constant agitation for 30 min at 50° C. The soap content of the oil was 85 ppm. The moisture content of the oil was 0.540 wt. %.

In the adsorption step, 300 g soapy oil was treated with 1.8 g (0.6 wt. %) TriSyl ® 600 silica under agitation for 30 min at atmospheric pressure and 70° C. The mixture was then transferred to a 100° C. water bath where vacuum (30 in. water) was applied with constant agitation for 20 min at 100° C. to bleach the oil. The mixture cooled to 70° C. and filtered.

The results of this example in Table 1 show a reduction in all impurities, yet residual soap remains.

Example 5

1000 g water degummed SBO of Example 1 was heated to 50° C. in a water bath. 0.187 g 85% $H_3PO_4$ was added to the oil at atmospheric pressure with constant agitation for 10 min at 50° C. 5.0 g 18 °Be (13 wt. %) NaOH solution was added to the acid-treated oil at atmospheric pressure with constant agitation for 30 min at 50° C. The soap content of the oil was 85 ppm. The moisture content of the oil was 0.399 wt. %.

700 g soapy oil was heated to 70° C. in a water bath. Vacuum (30 in. water) was applied with constant agitation for 10 min at 70° C. to remove the moisture. The moisture content of the dried oil was 0.203 wt. %.

In the adsorption step, 300 g dried soapy oil was treated with 1.8 g (0.6 wt. %) TriSyl ® 600 silica under agitation for 30 min at atmospheric pressure and 70° C. The mixture was then transferred to a 100° C. water bath where vacuum (30 in. water) was applied with constant agitation for 20 min at 100° C. to bleach the oil. The mixture cooled to 70° C. and filtered.

The results in Table 1 show substantial removal of all impurities. No residual soap remains.

Example 6

1000 g water degummed SBO of Example 1 was heated to 50° C. in a water bath. 0.100 g 85% $H_3PO_4$ was added to the oil at atmospheric pressure with constant agitation for 10 min at 50° C. 5.0 g 18 °Be (13 wt. %) NaOH solution was added to the acid-treated oil at atmospheric pressure with constant agitation for 30 min at 50° C. The soap content of the oil was 255 ppm. The moisture content of the oil was 0.515 wt. %.

700 g soapy water degummed oil were heated to 90° C. in a water bath. Vacuum (30 in. water) was applied with constant agitation for 3 min at 90° C. to remove the moisture. The moisture content of the dried oil was 0.208%.

In the adsorption step, 300 g dried soapy oil were treated with 1.8 g (0.6 wt. %) TriSyl ® 600 silica under agitation for 30 min at atmospheric pressure and 70° C. The mixture was then transferred to a 100° C. water bath where vacuum (30 in. water) was applied with constant agitation for 20 min at 100° C. to bleach the oil. The mixture cooled to 70° C. and filtered.

The results in Table 1 show a substantial reduction in the levels of all impurities. No residual soap remains.

TABLE 1

| Example No. | Created Soap ppm | P ppm | Ca ppm | Mg ppm | Fe ppm | FFA wt. % | Moisture wt. % | Residual Soap ppm |
|---|---|---|---|---|---|---|---|---|
| 1 | 445 | 1.53 | 1.17 | 0.48 | 0.00 | 0.01 | 0.040 | 76 |
| 2 | 107 | 0.49 | 0.01 | 0.00 | 0.00 | 0.03 | 0.039 | 6 |
| 3 | 125 | 0.54 | 0.04 | 0.00 | 0.00 | 0.05 | 0.031 | 0 |
| 4 | 85 | 0.49 | 0.01 | 0.00 | 0.00 | 0.01 | 0.039 | 12 |
| 5 | 85 | 0.30 | 0.04 | 0.05 | 0.00 | 0.03 | 0.038 | 0 |
| 6 | 255 | 0.78 | 0.13 | 0.06 | 0.00 | 0.04 | 0.037 | 0 |
| Starting oil | N/A | 67.41 | 29.05 | 12.65 | 0.27 | 0.15 | 0.031 | N/A |
| Control | 445 | 5.73 | 2.34 | 1.07 | 0.00 | 0.01 | 0.030 | 82 |

Example 7

1000 g degummed corn oil, analysis listed in Table 2, was heated to 50° C. in a water bath. 10.0 g 18 °Be (13 wt. %) NaOH solution was added to the oil at atmospheric pressure with constant agitation for 30 min at 50° C. The soap content of the oil was 1126 ppm. The moisture content of the oil was 1.118 wt. %.

In the drying step, 350 g soapy oil was heated to 70° C. in a water bath. Vacuum (30 in. water) was applied with constant agitation for 25 min at 70° C. to remove the moisture. The moisture content of the dried oil was 0.157 wt. %.

In the adsorption step, 300 g dried soapy oil was treated with 1.8 g (0.6 wt. %) TriSyl ® 600 silica under agitation for 30 min at atmospheric pressure and 70° C. The mixture was then transferred to a 100° C. water bath where vacuum (30 in. water) applied with constant agitation for 20 min at 100° C. to bleach the oil. The mixture was cooled to 70° C. and filtered.

The results in Table 2 show a substantial reduction in all impurities with no residual soaps.

Comparison Example

For comparison, an identical corn oil was treated by the same process as Example 7 above except the vacuum drying step was omitted. The results in Table 2 show substantial residual soap.

TABLE 2

| | Soap ppm | Moisture wt. % | FFA wt. % | P ppm | Ca ppm | Mg ppm | Fe ppm |
|---|---|---|---|---|---|---|---|
| Degummed Corn Oil | N/A | 0.138 | 0.97 | 4.01 | 0.03 | 0.23 | 0.15 |
| Comparison Example | 548 | 0.032 | 0.09 | <0.26 | 0.02 | 0.02 | <0.03 |
| Example | 0 | 0.030 | 0.08 | <0.26 | <0.01 | 0.01 | <0.03 |

TABLE 2-continued

| | Soap ppm | Moisture wt. % | FFA wt. % | P ppm | Ca ppm | Mg ppm | Fe ppm |
|---|---|---|---|---|---|---|---|
| 7 | | | | | | | |

What is claimed is:

1. In a process for treating a fatty material selected from the group consisting of glyceride oils, wax esters, and mixtures thereof, said fatty material containing water and soap, said process comprising:

a) contacting said material with a silica-based amorphous adsorbent whereby soap is adsorbed by said adsorbent, and b) subsequently removing said soap-containing adsorbent from said material, the improvement comprising drying at least a portion of said material prior to said contacting with adsorbent.

2. The process of claim 1 wherein said silica-based adsorbent contains up to 10 wt. % of other oxides.

3. The process of claim 2 wherein said silica-based amorphous adsorbent is selected from the group consisting of silica gel, precipitated silica, dialytic silica, fumed silica, silica-alumina and mixtures thereof.

4. The process of claim 1 wherein said material is dried to a water content of less than about 0.6 wt. %.

5. The process of claim 4 wherein said material is dried to a water content of about 0.1–0.2 wt. %.

6. The process of claim 1 wherein said drying comprises vacuum drying said material.

7. The process of claim 2 wherein said adsorbent comprises a silica gel.

8. The process of claim 7 wherein said silica gel comprises an acid-treated silica gel.

9. The process of claim 6 wherein said vacuum drying is performed at about 70°–110° C.

10. The process of claim 1 wherein said material contains about 20–3000 ppm soap just prior to said contacting.

11. The process of claim 10 wherein said material contains about 20–300 ppm soap just prior to said contacting.

12. The process of claim 1 wherein all of said material is dried prior to said contacting.

13. In a process for treating a fatty material selected from the group consisting of glyceride oils, wax esters and mixtures thereof, said process comprising:

a) combining said material with a base to form soap, b) contacting said soap-containing fatty material with a silica-based amorphous adsorbent whereby soap is adsorbed by said adsorbent, and c) removing said soap-containing adsorbent from said material, the improvement comprising:

i) combining said material with an acid prior to or during step a), and ii drying at least a portion of said material between steps a) and b).

14. The process of claim 13 wherein said process further comprises removing a portion of the soap from said soap-containing fatty material between step a) and drying step ii).

15. The process of claim 13 wherein the improvement further comprises iii) bleaching said material between steps b) and c).

16. The process of claim 13 wherein said drying step ii) comprises vacuum drying.

17. The process of claim 13 wherein said acid pretreatment comprises combining about 50–1000 ppm acid with said fatty material.

18. The process of claim 17 wherein said acid comprises phosphoric acid.

19. The process of claim 15 wherein said bleaching step iii) comprises vacuum bleaching.

20. The process of claim 19 wherein said material is contacted with a bleaching agent during said vacuum bleaching.

21. The process of claim 13 wherein said silica-based amorphous adsorbent contains up to 10 wt. % of other oxides.

22. The process of claim 21 wherein said silica-based amorphous adsorbent is selected from the group consisting of silica gel, precipitated silica, dialytic silica, fumed silica, silica-alumina and mixtures thereof.

23. The process of claim 22 wherein said adsorbent comprises a silica gel.

24. The process of claim 23 wherein said silica gel is an acid-treated silica gel.

25. The process of claim 16 wherein said vacuum drying is performed at about 70°–110° C.

26. The process of claim 13 wherein said material is dried to a water content of less than about 0.6 wt. % during drying step i) .

27. The process of claim 26 wherein said material is dried to a water content of about 0.1–0.2 wt. % during drying step i) .

28. The process of claim 13 wherein said material resulting from step a) contains about 20–3000 ppm soap.

29. The process of claim 28 wherein said material resulting from step a) contains about 20–300 ppm soap.

30. The process of claim 13 wherein all of said material is dried in step i).

31. The process of claim 13 wherein said material comprises phospholipid which is adsorbed during said contacting step b).

* * * * *